United States Patent [19]

Silvestri, Jr. et al.

[11] 4,277,943

[45] Jul. 14, 1981

[54] METHOD AND APPARATUS FOR SUPPLYING STEAM TO A TURBINE

[75] Inventors: George J. Silvestri, Jr., Upper Chichester; Krishnamurthy Kesavan, Monroeville, both of Pa.

[73] Assignee: Westinghouse Electric Corp., Pittsburgh, Pa.

[21] Appl. No.: 83,437

[22] Filed: Oct. 10, 1979

[51] Int. Cl.[3] ..... F01K 13/02

[52] U.S. Cl. ..... 60/646; 60/656

[58] Field of Search ..... 60/646, 656; 122/406 ST

[56] References Cited

U.S. PATENT DOCUMENTS

| | | | |
|---|---|---|---|
| 3,304,716 | 2/1967 | Griffin et al. | 60/646 |
| 3,362,164 | 1/1968 | Rudd | 60/646 |

*Primary Examiner*—Allen M. Ostrager
*Assistant Examiner*—Stephen F. Husar
*Attorney, Agent, or Firm*—G. H. Telfer

[57] ABSTRACT

A method and apparatus for supplying superheated steam at desired temperatures and pressures to a steam turbine. First source steam from a boiler steam drum passes through a control valve to form regulated steam which is conducted through a heat exchanger where a portion of it is condensed. The partially condensed regulated steam exhausted from the heat exchanger is throttled by a throttling valve to a lower pressure to form control steam and the vapor therein is separated from the liquid. The vapor is transmitted through the heat exchanger and absorbs heat from the regulated steam also passing therethrough. Cooperative adjustment of the control valve and throttling valve permits gradual adjustment of the control steam's temperature and pressure leaving the heat exchanger. When the control valve is completely open, the temperature of the control steam leaving the heat exchanger is a maximum which cannot be increased by further manipulation of the control and throttle valves. Such control steam is supplied to the turbine when the desired steam temperature is less than the temperature of a second, higher temperature source of steam. When the desired steam temperature approaches and surpasses the regulated steam temperature, the control steam is mixed with varying amounts of the second source steam. By cooperatively regulating a second steam source control valve, the first source steam control valve, and throttling valve, the desired resultant steam temperature can be attained until the desired temperature reaches that of the second source steam. At such time, second source steam alone is routed to the turbine.

7 Claims, 1 Drawing Figure

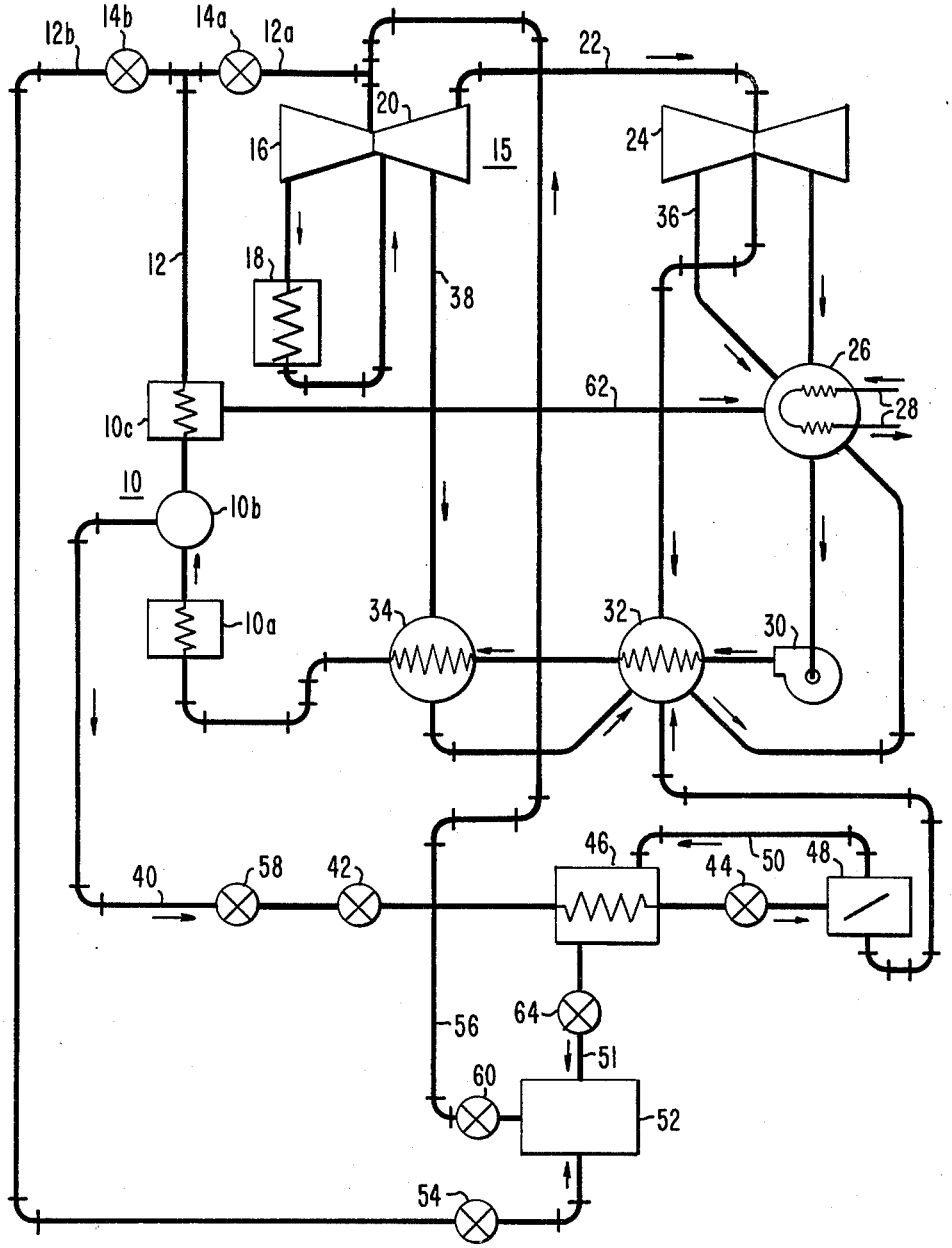
12b
14b
14a
12a
22
20
16
15
24
36
12
18
38
26
62
28
10c
10
10b
10a
34
32
30
40
58
42
46
44
50
48
56
64
51
60
52
54

METHOD AND APPARATUS FOR SUPPLYING STEAM TO A TURBINE

BACKGROUND OF THE INVENTION

1. Field of the Invention

This invention relates to adjusting the temperature and pressure of steam for use in a steam turbine, and more particularly, to means for supplying steam having varying degrees of superheat from steam sources that are dry and saturated, superheated, and a mixture thereof.

2. Description of the Prior Art

In central station power generation facilities large, relatively massive steam turbines are generally used to drive alternating current generators. Such steam turbines generally operate with a maximum temperature of 800°-1000° F. and 1000-2500 pounds per square inch throttle pressure. During steam turbine start-up, the temperature of the components therein must be gradually warmed to avoid inducing abnormally large thermal stresses.

Limits exist on the rate of temperature increase of the steam and the allowable temperature differences between the steam and the turbine components. Due to such limits, the temperature and pressure of steam flowing through a steam turbine during start-up are usually gradually increased from reduced values to operational values at the allowable rates. Steam temperatures from fossil fuel fired boilers are somewhat difficult to control at relatively low turbine loads and as a consequence, during turbine start-up, the boiler is sometimes the limiting factor for determining the precision in the rate of change of steam temperature and pressure supplied to the turbine. Temperature and pressure increases in boilers during turbine start-up are sometimes greater than allowable for use in the turbine as judged from reliability considerations. Precise control of steam temperature and pressure increases in a boiler has been attempted by regulating fossil fuel firing rate with limited success but, in general, such regulation has proven to be difficult.

Liquid metal fast breeder reactor (LMFBR) power plants are believed (by cost projections) to have higher capital costs and lower operating costs than conventional, fossil fuel power plants. For a utility to avail itself of such lower operating costs, on line availability and system component reliability in LMFBR systems must be maximized to ensure continuous operation. System and component reliability may be adversely affected by imprecise control of the temperature and pressure of the steam which was transmitted to the turbine throttle. For LMFBR plants, steam, during turbine start-up, is typically dry and saturated from the steam generator's steam drum or slightly superheated if taken from the steam generator's superheater. The steam pressure in LMFBR systems is typically approximately 5% higher than the main turbine design throttle pressure. Should such steam be throttled and sent to the main turbine, as proposed by some designers, at approximately 1000 psi (a reasonable start-up pressure), the steam would have between 2% and 12.5% moisture at the main turbine throttle. The moisture percentage will increase further because of throttling in the turbine throttle and/or control valves. Such moisture level can cause serious erosion and other operational problems including severe turbine chilling.

SUMMARY OF THE INVENTION

In accordance with the present invention an improved fluid supply system is provided in which the supplied fluid pressure and temperature are adjustable within predetermined ranges. The inventive apparatus generally comprises two valves in series flow relationship for reducing the pressure and temperature of a first source fluid to a regulated fluid and a controlled fluid when the desired fluid temperature is less than the temperature of a second source, higher temperature fluid, a heat exchanger for transferring heat from the regulated fluid to the vapor component of the controlled fluid wherein the heated vapor is fluidly communicable to a fluid utilizing device, a valve for regulating the flow rate of the second source fluid to the fluid utilizing device when the desired temperature is greater than the regulated fluid's temperature, and a mixer for mixing the heated controlled fluid vapor with the second source fluid to create a resultant fluid when the desired fluid temperature is greater than the regulated fluid's temperature and less than the second source fluid's temperature.

The method for producing fluid having an adjustable temperature and pressure, when practiced according to the present invention, generally comprises reducing the pressure and temperature of a first source fluid to create a regulated fluid and then a controlled fluid when the desired fluid temperature is less than the temperature of a second source, higher temperature fluid, heating the vapor component of the controlled fluid which is fluidly communicable with a fluid utilizing device, regulating the flow rate of the second source fluid to the fluid utilizing device when the desired fluid temperature is greater than the regulated fluid's temperature, and mixing the heated controlled fluid vapor with the second source fluid to create a resultant fluid when the desired fluid temperature is greater than the regulated fluid's temperature and less than the second source fluid temperature. After creating the controlled fluid, the vapor phase thereof is separated from the liquid phase of the control fluid prior to heating it. Heating the controlled fluid vapor is preferaby accomplished by transferring heat from the regulated fluid thereto. Pressure and temperature reduction of the first source fluid is preferably provided by cooperatively regulating two valves in series flow relationship to maintain the proper heated controlled fluid vapor temperature and pressure.

The aforementioned apparatus and method can provide superheated steam for virtually the entire operational pressure range of the utilizing device which is particularly useful since steam in the superheated state is the most desirable fluid for use in steam turbines. Such apparatus and method also enable a power plant operator to increase a steam turbine load to its rated capacity within the minimum time consistent with turbine reliability and system life, permit minimizing the size of the safety bypass steam system from the boiler to the condenser which is traditionally supplied to control temperatures in the turbine, and minimizes the heat energy dissipated during temperature and pressure regulation.

BRIEF DESCRIPTION OF THE DRAWINGS

The invention will be more fully understood from the following detailed description of the preferred embodiment taken in connection with the accompanying drawings in which:

Sole FIGURE is a schematic view of a power generation system.

DESCRIPTION OF THE PREFERRED EMBODIMENT

The present invention is concerned primarily with providing steam of variable temperature and pressure for steam turbines used in power plant applications. Accordingly, in the description which follows, the invention is shown embodied in a large central station power generation system utilizing steam-water as the motive fluid. It should be understood, however, that the invention may be utilized in any application to adjust the temperature and pressure of any substance when that substance (such as sodium) is in the fluid state.

The sole FIGURE illustrates a schematic view of a large central station power generation system in which the invention is incorporated. Feedwater enters boiler 10 and initially passes through evaporator section 10*a* where a portion of the feedwater is boiled into steam. Steam drum 10*b* is in series flow relationship with evaporator portion 10*a* and typically includes a steam water interface. For once-through boilers, 10*b* may be considered to be an intermediate header rather than a conventional boiler's steam drum. Steam from steam drum 10*b* is supplied to superheater section 10*c* where the steam is heated above the dry and saturated thermodynamic state point. While structure 10 is referred to as a boiler structure, it is to be understood that it may be a steam generator such as is commonly used for nuclear steam supplies or any other apparatus where heat energy is added to a fluid.

Conduit 12 leading from superheater portion 10*c* is bifurcated into steam supply lines 12*a* and 12*b*. During steady-state and other normal operating conditions, isolation valve 14*a* on steam supply line 12*a* is normally in the open position while isolation valve 14*b* on steam supply line 12*b* is normally closed so as to prevent steam flow therethrough. Superheated steam transmitted through steam supply line 12*a* is directed to fluid utilizing device or turbine 15. The steam inlet into turbine 15 is in high pressure turbine portion 16 where the steam's heat energy is converted (through expansion) into rotational energy which is used to drive an electrical generator (not shown). After expansion through high pressure turbine portion 16, the steam is exhausted into reheater 18 where additional heat energy is added prior to transmitting the reheated steam to intermediate pressure turbine portion 20. Steam expanded through intermediate pressure turbine portion 20 is exhausted into crossover conduit 22 which carries the steam to low pressure turbine portion 24. Low pressure turbine portion 24 allows further steam expansion and energy conversion and exhausts the steam into condenser apparatus 26. A relatively low pressure and temperature is maintained within condenser 26 by coolant circulated through coolant lines 28 in the direction of the indicated arrows. Although three turbine portions are illustrated (16, 20, and 24), it is to be understood that any number of turbine portions could be utilized and, furthermore, that the turbine portions may share a common shaft or have separate shafts. Additionally, while reheater 18 is illustrated as being between high and intermediate pressure turbine portions 16 and 20, respectively, for purposes of the present invention, reheater 18 could be anywhere in the cycle or even nonexistent.

Upon condensation in condenser 26, the steam's condensate is returned to boiler 10 by feed pump 30 through regenerative feedwater heaters 32 and 34. Heating steam for those feedwater heaters is extracted from low pressure turbine portion 24 and intermediate pressure turbine portion 20 through extraction lines 36 and 38, respectively. Steam transmitted through the extraction lines is condensed in the feedwater heaters from which it is cascaded to successively lower pressure feedwater heaters such as from feedwater heater 34 to feedwater heater 32. The condensate in the lowest temperature feedwater heater (32 in the illustrated example) is sent to the condenser 26. The feedwater transmitted by feed pump 30 is regeneratively heated in the feedwater heaters prior to returning it to boiler 10 so as to improve the power cycle's thermodynamic performance. Only two feed-water heaters (32 and 34) are illustrated in the sole FIGURE, but it is to be understood that any number of feedwater heaters could be utilized with equal facility with the present invention.

When steam turbine 15 is in a transient state such as during start-up from a relatively low temperature as compared to its steady-state normal operating temperature, thermal stresses on the components thereof can become excessive and adversely affect the components' lives if the steam supplied thereto has a temperature and pressure which are increased at an excessively rapid rate. To avoid such adverse operating conditions during start-up, steam from steam drum 10*b*, according to the present invention, is routed through steam conduit 40 to control valve 42. Steam from steam drum 10*b* or other fluid source such as superheater 10*c* is serially reduced in pressure to a regulated fluid and a controlled fluid in control valve 42 and throttling valve 44. The regulated fluid flows through heat exchanger 46 where a portion thereof is preferably condensed. Subsequent to passing through throttling valve 44 and being converted into a controlled fluid, a portion (magnitude being dependent on the pressure drop encountered) of the controlled fluid flashes to vapor.

The vapor phase of the controlled fluid is segregated from the liquid phase in separator 48 and is subsequently routed through connecting conduit 50 to heat exchanger 46. The reduced pressure and temperature controlled fluid vapor passing in heat transfer relationship with the regulated fluid (typically on the shell and tube sides respectively) accepts heat therefrom and has its temperature increased to a superheated condition. Such heated controlled fluid vapor passes from heat exchanger 46 to mixer 52 where it may be mixed with a second source fluid or high temperature, superheated steam transmitted through steam line 12*b*. The flow rate of the relatively higher temperature, second source superheated steam is regulated into mixer 52 by control valve 54. The steam mixture or resultant fluid is transmissible from mixer 52 through conduit 56 to the inlet of high pressure turbine portion 16.

Use of the aforementioned apparatus permits the temperature and pressure of the steam supplied to turbine 15 to be gradually increased at predetermined rates consistent with the strength of materials used in the turbine components. It has been found that certain "heat soaks" or extended time exposures to specific warming temperatures are required to prevent the life of certain turbine components from being adversely affected. The aforementioned predetermined rates of increasing the temperature and pressure of the steam supplied to turbine 15 is dependent upon, among others, the size, materials, and number of operational service years. When the desired steam temperature and pressure has been obtained, flow through turbine 15 can be increased by decreasing the flow through start-up supply line 56 and increasing the flow through supply line 12*a*. When the steam flow rate (at the desired operating pressure and temperature from superheater portion 10*c* to the high pressure turbine portion 16) reaches a predetermined minimum, flow through steam line 12*b* is terminated by closing isolation valve 14*b*, steam flow through steam line 40 is obstructed by closing isolation valve 58, and additional increases in the superheater portion's steam temperature and pressure are isolated from the elements of the present invention by closing isolation valve 60. By use of the illustrated invention, any bypass system such as the illustrated conduit 62 which fluidly connects superheater 10*c* with condenser 26, may be drastically reduced in size since the bypass system's primary function of controlling turbine component temperatures with steam of desired pressure and temperature has been assumed by the present invention with more precise control and less inefficiency.

When turbine 15 is to undergo a "cold" or "warm" start, steam is transmitted from steam drum 10*b* or other suitable cycle location. Control valve and throttling valve, 42 and 44 respectively, are cooperatively regulated to control the temperature and pressure, respectively, of the controlled fluid vapor routed through heat exchanger 46. The low pressure steam or controlled fluid vapor passing through connecting conduit 51 will have its pressure and temperature gradually increased by the cooperative regulation of valves 42 and 44 until a predetermined temperature is reached. The predetermined temperature would be equal to the regulated fluid temperature for the ideal case of no losses and use of a very large heat exchanger 46. At such time control valve 42 would preferably be in the completely open position and throttling valve 44 would be maintaining the controlled fluid pressure at the desired level. Prior to reaching such predetermined pressure and temperature, the heated controlled fluid vapor entering mixer 52 would exit mixer 52 through line 56 and be routed to high pressure turbine portion 16 for its subsequent expansion through the turbine.

To obtain further increases in the steam pressure and temperature supplied to high pressure turbine portion 16, a second source steam must be mixed with the heated controlled fluid vapor in the mixer 52. Such mixing obtains from cooperatively regulating control valves 42 and 54 and throttling valve 44 so as to provide the desired temperature and pressure of the steam flowing through supply conduit 56. In actuality, control valve 54 will be increasingly opened while control valve 42 and throttling valve 44 will be increasingly closed albeit at different rates of change. When the desired temperature and pressure of the steam flowing through steam supply line 56 is at least as high as the steam routed to mixer 52 through conduit 12*b*, only the superheated steam routed through conduit 12*b* will be transmitted through supply line 56 since flow through conduit 40 will be discontinued by closing valves 42, 44, and 58. Isolation valve 64, situated between heat exchanger 46 and mixer 52 will also be closed after the desired steam temperature has reached that of steam supplied through conduit 12*b*. Closing isolation valve 64 prevents exposure of heat exchanger 46 and separator 48 from further increases in the pressure of the steam supplied to high pressure turbine portion 16. The aforementioned method and apparatus is utilized until approximately 10% of rated throttle flow is supplied to turbine 15. At such time, isolation valves 14*b* and 60 will be closed while isolation valve 14*a* will be opened.

Copending Application Ser. No. 083,436 by G. J. Silvestri, filed Oct. 10, 1979 and assigned to the assignee of the present invention, illustrates an apparatus suitable for supplying relatively low pressure, low temperature superheated steam to utilizing devices such as boiler feed pump turbines which do not typically require high superheat in their utilizing steam. Main turbines in large central station power plants, however, typically utilize steam of high superheat since it can provide greater economy of operation. It has been determined that for a throttle flow of approximately 900,000 pounds per hour a heat transfer surface area of approximately 34,000 square feet is required for an 11° F. terminal temperature difference in heat exchanger 46. Successively lower surface areas are required, of course, for successively higher terminal temperature differences.

The aforementioned system and method for increasing the steam's pressure and temperature will significantly increase the reliability of most power generation equipment and most notably the turbine 15. Additionally, the normal bypass system 62 which is provided for safety reasons and used to somewhat control the steam flow and temperature through the turbine 15 can be decreased in size with a concomitant cost reduction. The use of the present invention in power cycles such as LMFBR's having non-integral, recirculating steam generators permits turbine start-up prior to superheated steam availability from the steam generator. As a result, the normal delay in turbine operation after initiation of steam generator operation is avoided and turbine operation is expedited.

Furthermore, the rate at which the main turbine 15 can be loaded in a manner consistent with safety is greatly increased.

It will now be apparent that an apparatus and method have been provided in which the temperature and pressure of the steam transmitted to the main turbine can be adjusted within predetermined ranges so as to effect a safer and more controlled turbine start-up while maximizing the efficiency of the entire generation system during that time.

We claim:

1. A system for providing fluid having pressures and temperatures which are adjustable within predetermined ranges, said system comprising:

means for successively reducing the pressure and temperature of a first source fluid to respectively produce a regulated fluid and a controlled fluid when the desired fluid temperature is less than the temperature of a higher temperature, second source fluid;

means for heating the vapor component of the controlled fluid with said regulated fluid, said heating means being in fluid communication with a fluid utilizing device;

means for regulating the flow rate of said second source fluid to the fluid utilizing device when the desired fluid temperature is greater than the regulated fluid's temperature; and means in fluid communication with said heating means, flow rate regulating means, and fluid utilizing device for mixing the heated controlled fluid vapor with the second source fluid to create a resultant fluid when the desired fluid temperature is greater than said regulated fluid's temperature and less than said second source fluid's temperature:

2. The system of claim 1 further comprising: means for separating the controlled fluid into its vapor and liquid components, said separated vapor being fluidly communicable with said heating means.

3. A method for producing fluid having a pressure and temperature which are each adjustable within a predetermined range, said method comprising:

reducing the pressure and temperature of a first source fluid to serially create a regulated fluid and a controlled fluid when the desired fluid temperature is less than the temperature of a higher temperature, second source fluid;

heating the vapor component of the controlled fluid, said heated vapor being fluidly communicable with a fluid utilizing device;

regulating the flow rate of the second source fluid to the fluid utilizing device when the desired fluid temperature is greater than the regulated fluid's temperature; and mixing the heated controlled fluid vapor with the second source fluid to create a resultant fluid when the desired fluid temperature is greater than the regulated fluid's temperature and less than the second source fluid's temperature, said resultant fluid being transmissible to the fluid utilizing device.

4. The method of claim 3, said vapor heating comprising:

transferring heat from the regulated fluid to the controlled fluid vapor.

5. The method of claim 3, wherein said pressure and temperature reduction comprises:

cooperatively regulating two valves in series flow relationship.

6. The method of claim 3, wherein said mixing comprises:

cooperatively regulating the flow rates of said first and second source fluids.

7. The method of claim 3, further comprising:

separating the vapor phase from the liquid phase of the controlled fluid.

* * * * *